US006431722B1

(12) United States Patent
Benensohn

(10) Patent No.: US 6,431,722 B1
(45) Date of Patent: Aug. 13, 2002

(54) UNDER-CABINET LIGHTING FIXTURE

(75) Inventor: Sanford H. Benensohn, Beverly Hills, CA (US)

(73) Assignee: Lusa Lighting, Inc., Valencia, CA (US)

( * ) Notice: Subject to any disclaimer, the term of this patent is extended or adjusted under 35 U.S.C. 154(b) by 0 days.

(21) Appl. No.: 09/636,627

(22) Filed: Aug. 11, 2000

(51) Int. Cl.[7] ..... A47B 23/06

(52) U.S. Cl. ..... 362/133; 362/365; 362/368; 362/549

(58) Field of Search ..... 362/549, 362, 362/364, 365, 373, 147, 374, 375, 33, 294, 310, 368, 133

(56) References Cited

U.S. PATENT DOCUMENTS 5,909,955 A 6/1999 Roorda ..... 362/368
6,050,708 A * 4/2000 Roorda ..... 362/375

OTHER PUBLICATIONS

Evolution Minilites Collections brochure, 1900 N. Andrews Ave, Ext., Suite C, Pompano Beach FL 33069 (undated).

Outwater Hardware Catalog pp. 154, 155; Outwater Hardware Corporation, 11 West End Road, Totowa, NJ 07512 (1998).

Laura & Honnelore Co., Ltd flyer in GES Lightning Review Catalog, Oct. 1998.

Home Lightning and Accessories, Disc Light, Apr. 1996, p. 133.

Lightning Concepts, Outwater Plastics Industries, Inc., 4 Passaic Street, PO Drawer 403, Wood–Ridge, NJ 07075 (undated).

Lusa Lightning Inc., product card, 20W Combilight, 1994.

* cited by examiner

*Primary Examiner*—Alan Cariaso
*Assistant Examiner*—John Anthony Ward
(74) *Attorney, Agent, or Firm*—Baker, Donelson, Bearman & Caldwell

(57) ABSTRACT

An under-cabinet lighting fixture for permanent mounting having a housing suitable for recess or surface mounting and connected by a stem to a junction box mounted to an upper surface for electrical wiring connections. The stem defines a passageway for the electrical wiring to route from the housing to the junction box.

23 Claims, 5 Drawing Sheets

UNDER-CABINET LIGHTING FIXTURE

TECHNICAL FIELD

The present invention relates to under-cabinet lighting fixtures. More particularly, the present invention relates to permanently mounted under-cabinet lighting fixtures.

BACKGROUND OF THE INVENTION

Lights and lighting not only provide useful general illumination of interior and exterior spaces in homes and buildings, but also provide ornamental and artistic treatments for decorative purposes. These purposes include lighting functions as well as highlights for artwork, for accent and interior ornamental design functions, and other functions. Often furniture or cabinetry have lights for illuminating articles held within the furniture or cabinets. For cabinets, and in particular kitchen wall cabinets, lighting fixtures are often mounted to a lower exterior surface or recessed therein, for providing lighting to countertop surfaces below the cabinets. In a "recess" application, a cavity within a shelf receives the light fixture. The lighting fixture thereby has a reduced profile outwardly of the mounting surface.

One type of lighting fixture useful for under-cabinet applications is known as under-cabinet puck lights. These lights are generally cylindrical disc-shaped housings. The housings contain a reflector, a lamp socket with a light emitive bulb, and a glass lens for transmitting light from the housing to the countertop surface below the cabinet. The socket connects to a supply of electrical current. The lights provide several pools of lights to the countertop surface, and are used typically in kitchens and display cabinetry for providing light on the working surfaces in kitchens as well as for use in highlighting articles in display cabinets.

Under-cabinet puck lights originated in the European lighting market a number of years ago by primarily German and Italian manufacturers. These under-cabinet puck lights included transformers to provide 12 volt direct current for illuminating the light bulbs. The transformer connects to line voltage, which in Europe is 220 volt alternating current, to provide the electrical current for operating the lights at the stepped-down voltage. Generally, a plurality of the under-cabinet puck lights connect by electrical wires to the transformer. These lighting systems were known as low voltage systems, due to operation with the stepped-down direct current of 12 volts from the transformer.

While the under-cabinet puck lights provide light to work areas, the brightness of the illuminative effect has not been entirely satisfactory. In response, Lusa Lighting of Los Angeles, Calif., developed low-voltage puck lighting systems using halogen bulbs. Halogen bulbs provide a significantly higher light output per watt as compared to conventional incandescent bulbs. Low voltage under-cabinet halogen light systems use the low voltage transformers and wiring components discussed above. These systems have a maximum of approximately 20 watts per lighting fixture installed in surface mount or recessed mount applications. More recently, Lusa Lighting also developed a high voltage (line voltage) puck lighting system. This system includes lights that uses alternating current, line 120 voltage.

Generally, these low- and high-voltage puck-type lighting systems are provided commercially as after-market installation devices. The low voltage direct current lighting systems are readily installed by connecting the transformer directly to the line current and then using low-voltage wiring to connect the lights to the transformer. These connections and wiring do not require special electrical junction boxes or special conduit, and the wiring may be exposed, although preferably the wiring is placed at side edges of the shelf or other support surface to which the lighting fixture was attached. The low voltage lights generate little heat during operation, and are appropriate for use mounted to wooden surfaces under kitchen cabinetry or recessed into shelf portions of cabinets. On the other hand, the high voltage system provided satisfactory communication of the heat from the puck lights to the ambient atmosphere, while overcoming the limitations of the low voltage systems including radio frequency interference with the transformers, total light wattage limited to the capacity of the transformer, and reduced light output due to line losses for increased distances between the light and the transformer.

While the puck-type under-cabinet lighting fixtures have been satisfactory in after-market installations, there are drawbacks to the use of these lighting fixtures for permanent installation by the cabinet manufacturer prior to selling the cabinet and included light in the marketplace. These drawbacks include the need for appropriate junction boxes for electrical connections of the wiring, for conduit through which the electrical wires pass between the source of the current and the light, and for satisfactory access to control switches for activating the lights for use.

Accordingly, there is a need in the art for an improved under-cabinet lighting fixture for permanent surface and recessed mounting. It is to such that the present invention is directed.

BRIEF SUMMARY OF THE PRESENT INVENTION

The present invention provides a under-cabinet lighting fixture for permanent surface and recessed mounting, with a housing adapted to receive a light bulb for mounting to a cabinet surface and a junction box adapted for receiving electrical wires for connecting the light in the housing to a supply of electrical current. A stem, for being disposed within a hole in the cabinet surface, connects the housing and the junction box, while the stem defines a passageway for electrical wires from the junction box to the light in the housing.

In a preferred embodiment, the stem defines a keyed distal end that matingly engages a socket in the housing of the light fixture and an opposing distal end defines a thread for receiving a nut to secure the lighting fixture to the junction box.

Objects, advantages, and features of the invention will be come apparent upon a reading of the following detailed description of the present invention in conjunction with the drawings and the appended claims.

DETAILED DESCRIPTION OF THE PREFERRED EMBODIMENTS

Figure 1:
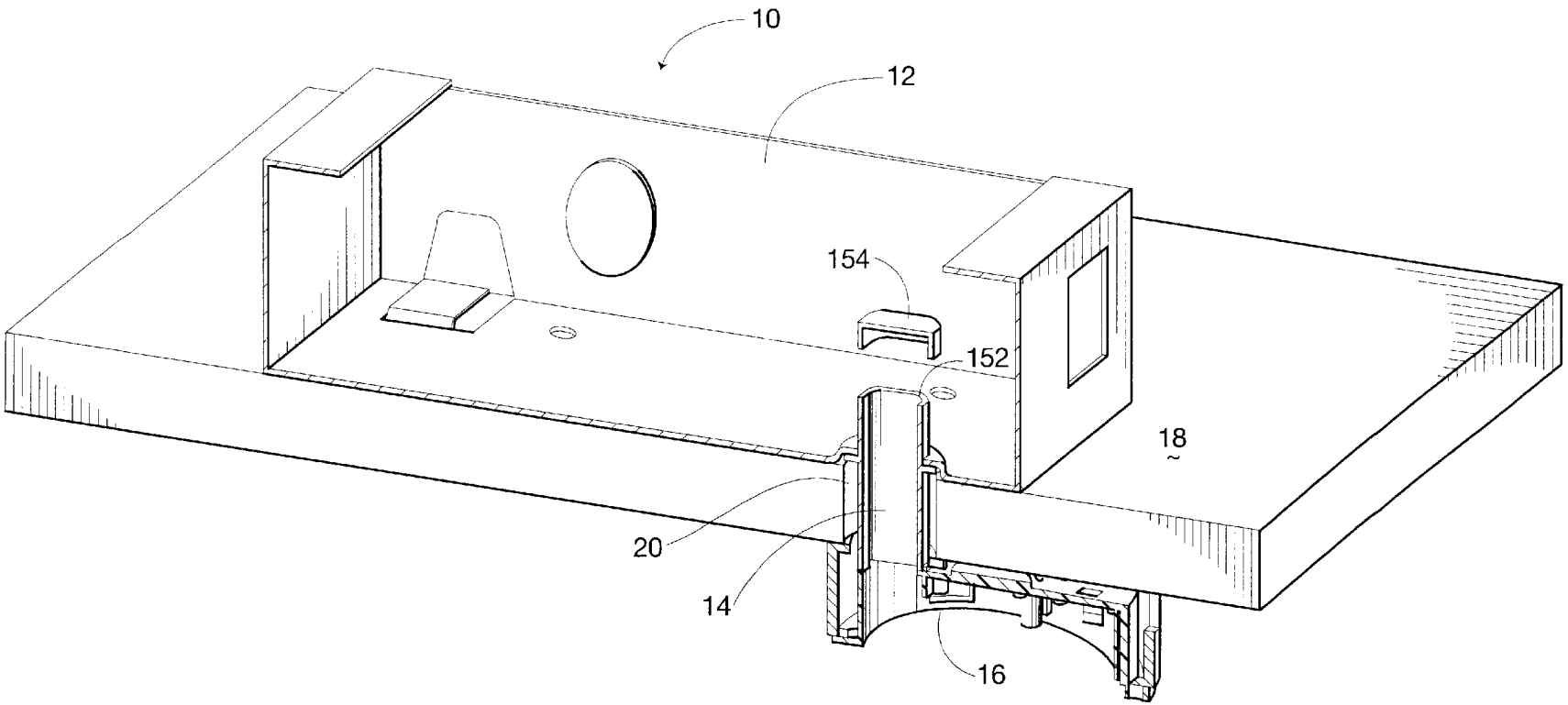
FIG. 1 is a perspective, cut-away view of a permanent under-cabinet lighting fixture according to the present invention.

Referring now in more detail to the drawings in which like parts have like identifiers, FIG. 1 illustrates in perspective cut-away view a permanent under-cabinet lighting fixture 10 according to the present invention with a junction box 12 connected by a stem 14 to a puck-type light fixture 16. The junction box 12 mounts to an upper surface of mounting board or shelf 18 of a cabinet (partially illustrated). The stem 14 extends through a hole 20 in the shelf 18 and connects to the lighting fixture 16. The permanent under-cabinet light fixture 10 in the illustrated embodiment is adapted for mounting as a surface mount (as illustrated in FIG. 1) or for recessed mounting in a shelf of a cabinet, as discussed below.

Figure 2:
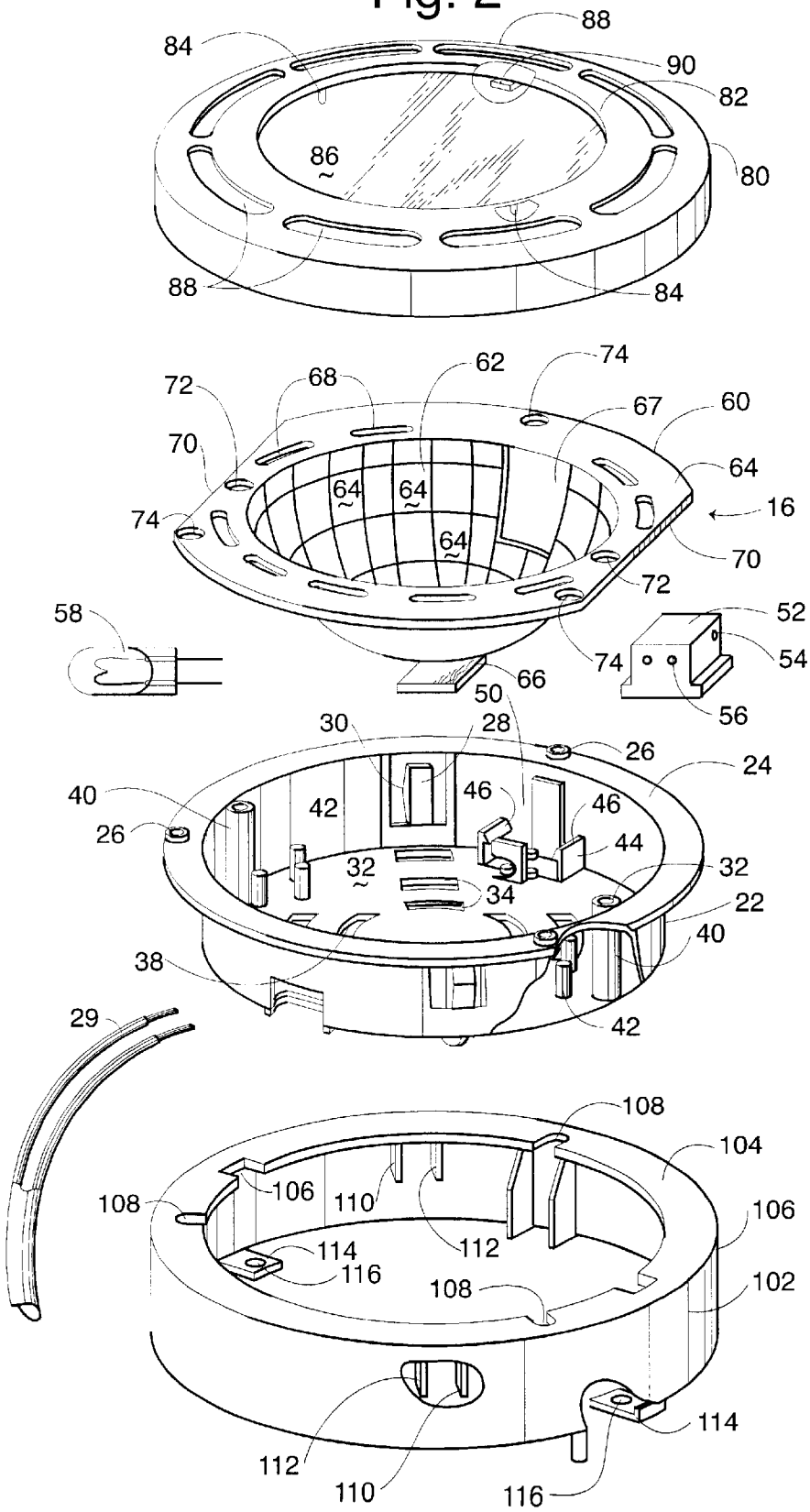
FIG. 2 is an exploded perspective view of the permanent under-cabinet lighting fixture illustrated in FIG. 1.

FIG. 2 is an exploded perspective view of the lighting fixture 16 illustrated in FIG. 1. The light fixture 16 comprises a housing 22 having an open end with a flange 24 extending laterally therefrom. Three posts 26 extend from a first surface of the flange 24. A pair of opposing tabs 28 are defined in the side wall of the housing 22. The tabs 28 are engaged at a first end to the housing 22 for flexible movement relative to the housing, for a purpose discussed below. The tabs 28 include an outwardly extending tip 30.

Figure 3:
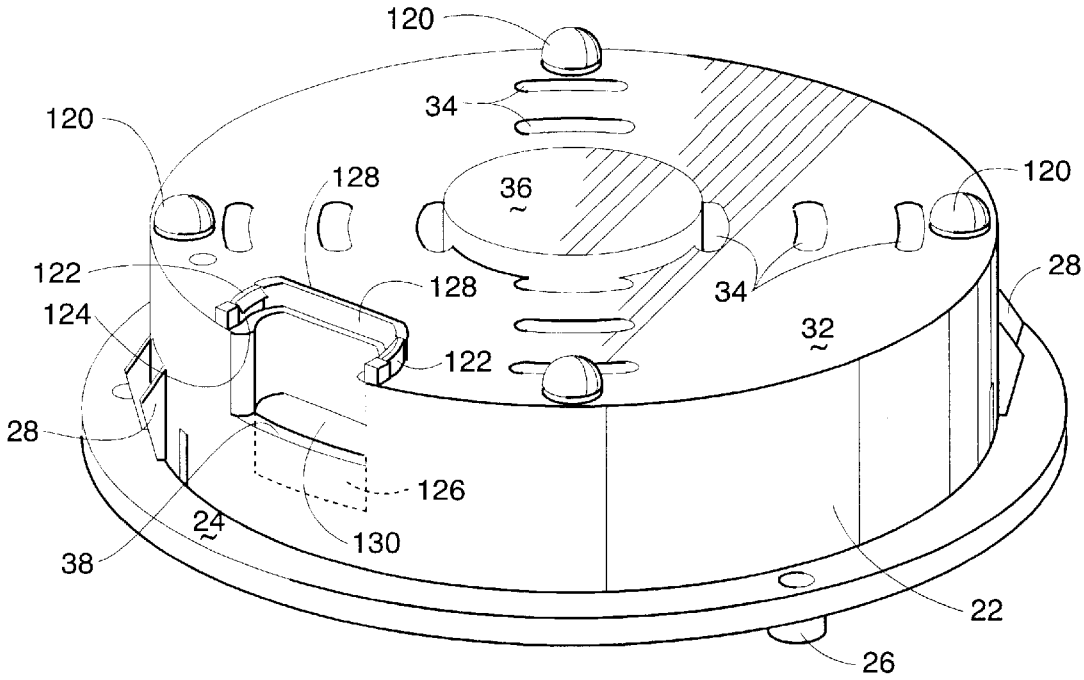
FIG. 3 is a perspective bottom view of the housing for the permanent under-cabinet light fixture shown in FIG. 2.

The housing 22 defines a partially closed bottom 32 having a plurality of openings 34. In the illustrated embodiment, the openings 34 are aligned slots defining concentric rings arranged radially. In the illustrated embodiment for a high voltage (line 120 volt alternating current lighting fixture), a central portion 36 defines a thickened portion of the bottom 32, as best illustrated in FIG. 3. In this embodiment, the thickened portion extends 0.06 inches from the surface of the bottom 32, to approximately double the thickness of the bottom in the central portion 36. The thickness may differ depending on the thermal transmission characteristics of the material used to form the housing 22. A socket 38 (best illustrated in FIG. 3) is defined in the side wall and bottom 32 of the housing 22 for receiving a distal end of the stem 14. As discussed below, the stem 14 defines a pathway for passage of a pair of electrical wires 29. A pair of posts 40 extend from the open end of the housing 22 to the bottom 32 on opposing sides of the housing. The posts 40 each define a bore extending along a longitudinal axis of the post. Studs 42 extend from the bottom 32 and are spaced-apart from each of the respective posts 40.

A pair of tabs 44 extend upwardly from the bottom 32. Each tab 44 defines an angled hook 46 at a distal end. A plate 48 extends upwardly from the bottom 32. The plate 48 is disposed radially inwardly from the side wall of the housing and between the tabs 44. The tabs 44, the plate 48, and a side portion of the housing 22 cooperatively define a recess 50 for receiving a lamp socket 52. The lamp socket 52 defines opposing openings 54 for receiving the ends of the electrical wires 29 and lamp post sockets 56 for engaging a lamp 58.

The lighting fixture 16 includes a reflector 60. The reflector 60 preferably is a stamped aluminum member defining a dish-shaped cavity 62 with a laterally extending flange 64. The reflector 60 with its flange 64 seats on the three posts 26 on the upper surface of the flange 24 of the housing 16. This defines air flow pathways therebetween. In the illustrated embodiment, the face of the dish-shaped cavity 62 defines a plurality of facets 64 for reflecting light. For a high voltage (120 volt) application, a pad 66 of an insulative material is disposed between the thickened portion 36 and the reflector 60. An opening 67 is defined in a side of the reflector 60. The opening 67 is configured for receiving therethrough a portion of the lamp socket 52. The flange 64 defines a plurality of openings 68 at an edge of the cavity 62. In the illustrated embodiment, the openings are elongate slots. The flange 64 defines a pair of opposing flats 70 each with an adjacent opening 72. Also, in the illustrated embodiment, three other openings 74 are defined in the flange 64. The openings 74 are spaced-apart uniformly on a perimeter edge portion of the flange 64 to align with the posts 26.

A cap 80 closes the housing 12. The cap 80 defines a central opening 82. A plurality of fingers 84 extend from an inner surface of a cap adjacent the central opening. The fingers 84 preferably angle towards the opening 82. The fingers 84 cooperatively engage a glass lens 86. In a preferred embodiment, the glass lens is a UV filter for reducing emissions from halogen light bulbs preferably used with the lighting apparatus 10. A plurality slot-like of openings 88 are defined in the cap 80. A pair of ears 90 extend radially inwardly from a skirt of the cap 80 on opposing sides.

The lighting fixture 16 described above is particularly useful for recessed mounting in cabinets, as discussed below. Also illustrated in FIG. 2 is a surface can 100 for surface mounting of the lighting fixture 16. The can 100 defines an annular ring 102 having a inwardly extending flange 104. A pair of opposing notches 106 are defined in the flange 104. Further, the three arcuate slots 108 are defined in the flange 104. The slots 108 align with the openings 74 in the reflector 60 for a purpose discussed below. Off-set from the notches 106 are two pairs of opposing side flanges 110, 112. Also, in the illustrated embodiment, two pairs of opposing supports 113, 115 are disposed intermediate the notches 106, and preferably on a side wall medial the notches. The supports 113, 115 extend between the flange 104 and the opposing edge of the can 100. A pair of opposing shoes 114 extend radially towards each other from a lower edge of the side wall of the ring 102. Each shoe 114 defines an opening 116. In one embodiment (not illustrated), a plurality of pins extend from the ring 102 opposing the flange 104. The pins space the can from a surface to which the lighting fixture 16 mounts and defines airflow pathways between the light fixture 16 and the mounting surface. In another alternate embodiment, the can 100 defines a plurality of spaced-apart holes in the side wall for airflow out of the can. The air flow features of the slots 68, the openings 34, and the spacing posts 120 (discussed below) facilitate communication of heat from the light bulb in the light fixture, particularly for lighting fixture applications using high voltage (line 120 voltage alternating current, for example.

FIG. 3 is a perspective bottom view of the housing 22 for the lighting fixture 16 illustrated in FIG. 2. In this embodiment, a plurality of posts 120 extend from the bottom 32 opposing the open end of the housing 16. The posts 120 define dome-shaped distal ends. These ends reduce the heat transfer from the contact of the housing 16 to the mounting surface 18 in surface mount applications. The socket 38 receives one end of the stem 14. A pair of opposing retaining clips 122 extend from the bottom 32 and define portions of side walls extending from the socket 38. The clips 122 define projecting lips 124. The socket 38 is preferably keyed, for specific alignment of the stem 14 with the socket 38. This is accomplished in the illustrated embodiment by the socket 38 defining a depending stepped recess 126 in a side wall of the housing 16. Also, the socket 38 is keyed, by the arcuate faces of the retaining clips 122 spaced apart by a planar wall 128. The socket 38 is open through a hole 130 to an inner cavity of the housing 16.

Figure 4:
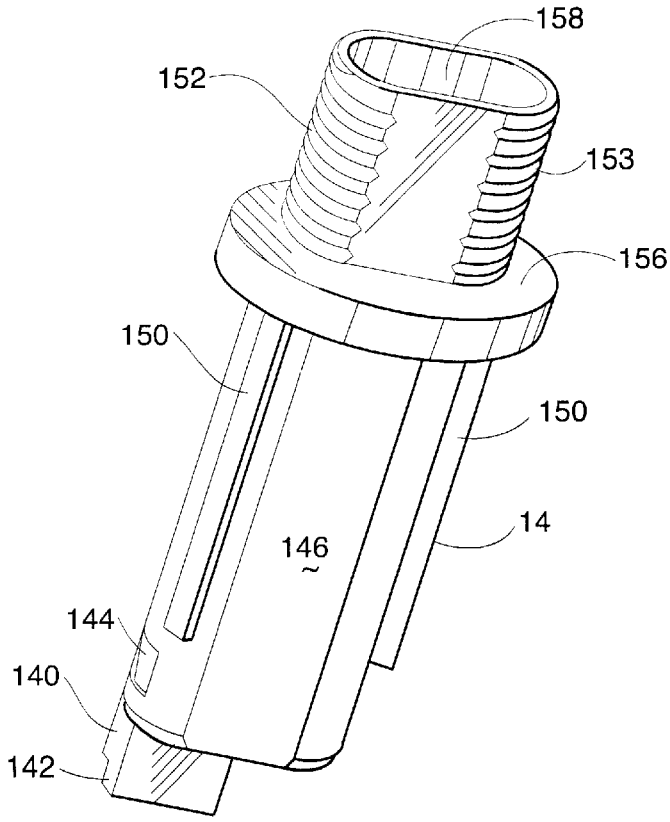
FIG. 4 is a perspective view of a stem for connecting the junction box and lighting fixture components of the permanent under-cabinet lighting fixture illustrated in FIG. 1.
Figure 5:
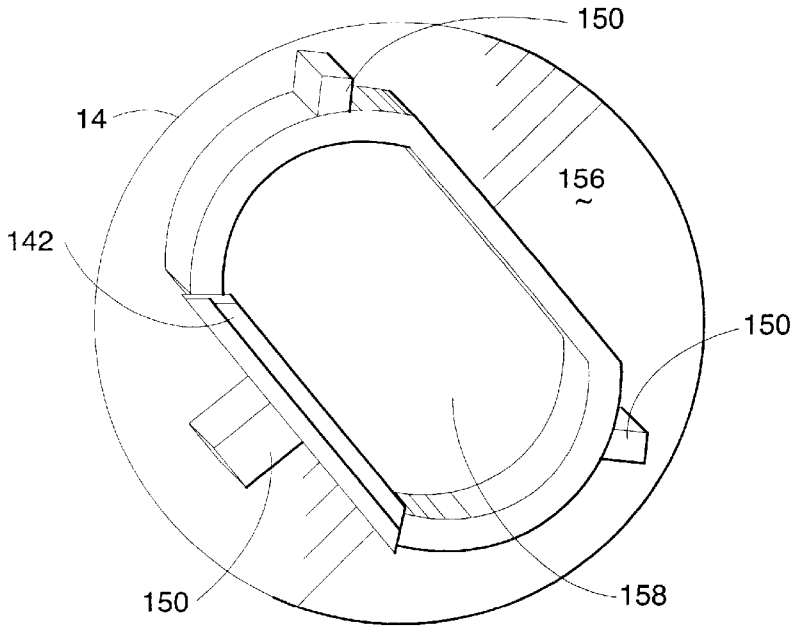
FIG. 5 is a perspective lower view of the stem illustrated in FIG. 4.

FIG. 4 is a perspective view of the stem 14 for connecting the junction box 12 and the lighting fixture 16 of the permanent under-cabinet lighting fixture 10 illustrated in FIG. 1. The stem 14 defines a first end 140 shaped for mating engagement with the socket 38. In the illustrated embodiment, the first end 140 defines a longitudinally extended flange 142 which is matingly received in the stepped recess 126 in the socket 38. Opposing sides of the stem define recesses 144 that receive the retaining clips 122. The lips 124 lock the retaining clips 122 to the recesses 144. A planar side wall 146 conforms in shape to the side wall 128. As best illustrated in FIG. 5, three ribs 150 are equally spaced about the perimeter of the stem 14. The ribs 150 extend radially outwardly, and prevent contact of the stem 14 with portions of the shelf 18 in the hole 20. An opposing distal end 152 defines a thread 153 for receiving a nut 154 (illustrated in FIG. 1). The thread 153 extends to a plate 156 disposed longitudinally inwardly from an end of the stem 14. The stem 14 defines a passageway 158 extending longitudinally therethrough. The electrical wires 29 are received in the passageway 158 for connecting a light bulb in the lighting fixture 16 to a supply of electrical current.

Figure 6:
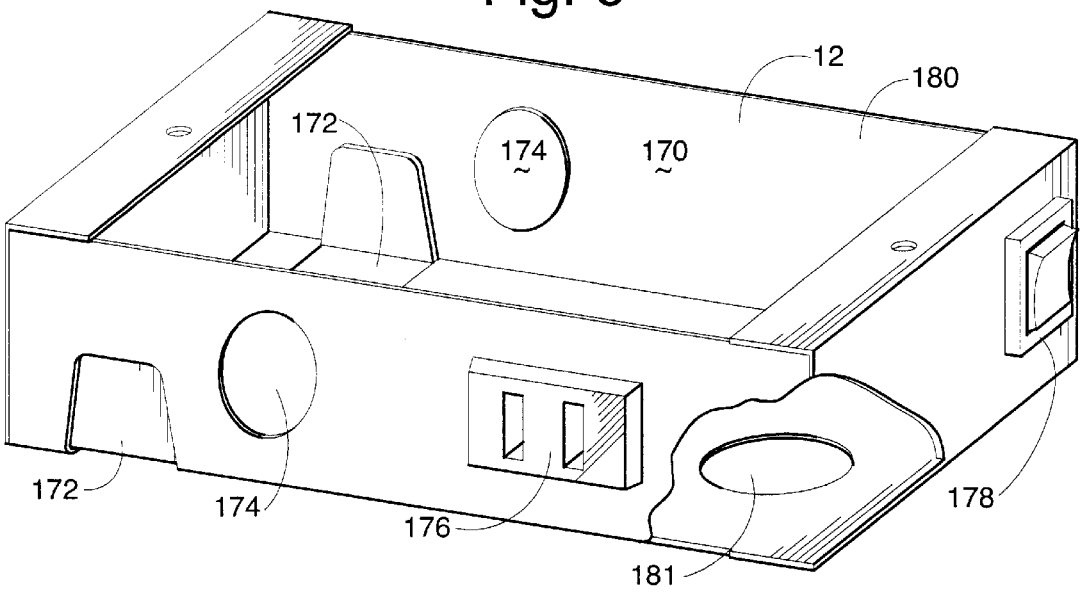
FIG. 6 is a perspective view of a junction box for the permanent under-cabinet lighting fixture illustrated in FIG. 1.

FIG. 6 is a perspective view of the junction box 12 for the permanent under-cabinet lighting fixture 10 illustrated in FIG. 1. The junction box 12 has side walls 170 that define knockouts 172, 174 shaped for receiving conventional electrical wiring conduits, such as circular or rectangular conduit. The illustrated embodiment includes opposing pairs of the knockouts 172, 174 for gang-connecting two or more of the junction boxes 12 together. A convenience outlet 176 mounts in one side wall 170 for a 120 volt line output, in an embodiment using line voltage into the electrical junction box 12. For example, a low-voltage application may have a transformer (not illustrated) mounted within the junction box 12, which transformer connects to line voltage. Also, an electrical switch 178 mounts to one end wall. The junction box 12 defines a cavity 180 for receiving the various connections of electrical wiring within the junction box. A bottom wall defines an opening 181 for receiving the threaded end 152 of the stem 14. The nut 154 (illustrated in FIG. 1) engages the end 152 to secure the stem 14 to the junction box 12.

Figure 7:
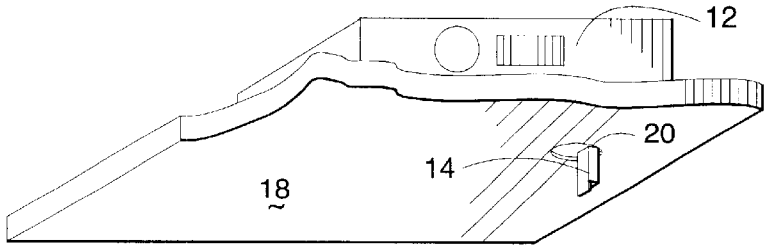
FIGS. 7 and 8 are perspective bottom views of a surface mount application of the permanent under-cabinet lighting fixture according to the present invention.
Figure 8:
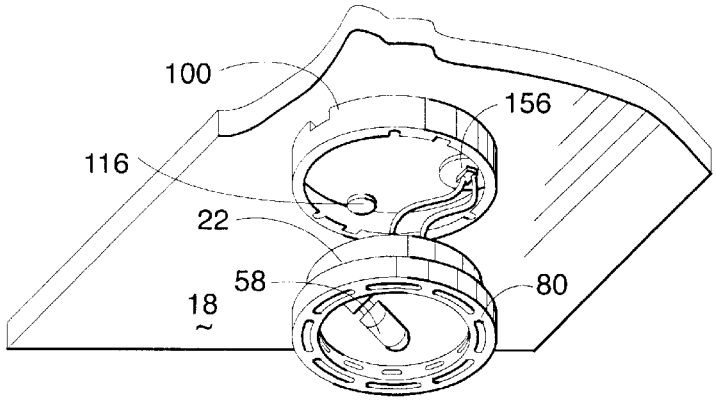
Figure 9:
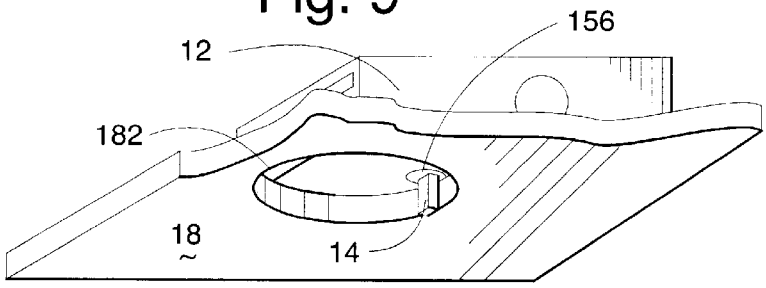
FIGS. 9 and 10 are perspective bottom views of a recessed mount application of the permanent under-cabinet lighting fixture according to the present invention.
Figure 10:
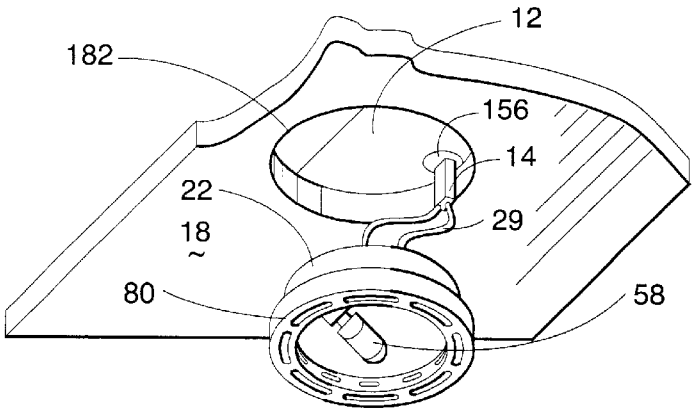

FIGS. 7 and 8 are perspective views of a surface-mounting installation for the light fixture 10. In surface mounting, the housing 22 is received within the can 100 and mounted with screws extending through the holes 116 in the shoes 114 to the mounting surface 18. FIGS. 9 and 10 are perspective views of a recessed mounting installation of the lighting fixture 10. In this installation, the surface can 100 is not used. Rather, the housing 12 is secured within a recess 182 in the mounting surface 18 with screws extending through the openings 74 and the aligned posts 26 in the flange 24. In both installations, the cap 80 closes the housing 12.

For use, the electric wires 29 pass through the stem 14 into the housing 22 and separate. The separate wires loop through the respective studs 42 adjacent the posts 40 on opposing sides of the housing 22. The distal ends of the electric wires 29 are electrically connected to the socket 52 through the opposing holes 54. The socket 52 is secured in the recess 50 by the tabs 44.

In the preferred embodiment, the insulative pad 66 is placed on the thickened central portion 36. The reflector 60 is inserted into the housing 22 and seats on the pad 66. A bulb, preferably a halogen bulb, is engaged to the lamp holes 56 in the socket 52.

As illustrated in FIGS. 9 and 10, the housing 22 may be installed in the annular recess 182 of the mounting surface 18. This is accomplished by locating an appropriate position on the mounting surface 18 for placement of the junction box 12 and the light fixture 16. A hole sized for receiving the housing 22 is created, such as by drilling or other cutting operation, to create the recess 182. The stem 14 is connected to the junction box 12. This is done by extending the threaded end 152 through the opening 181 in the junction box 12. The plate 156 bears against the bottom of the junction box 12. The nut 152 is threaded onto the end 152 to rigidly connect the stem 14 to the junction box 12.

The junction box 12 is positioned over the recess 182 with the stem 14 extending through the recess 182. The junction box 12 is mounted to an upper surface of the mounting surface 18. Generally, screws pass through securing holes (not illustrated) in the junction box 12, or with other conventional mounting mechanisms.

The electrical wires 29 are routed from the housing 22 through the lower end 140 of the stem 14 and outwardly from the end 152. The light housing 22 is pushed into the recess 182. This engages the end 140 of the stem 14 with the socket 38. The retaining clips 122 engage the recesses 144. The lips 124 of the clips 122 hold in the recesses to lock the stem 14 to the housing 22. In the illustrated embodiment, the flange 142 is slidingly received in the stepped recess 126 of the socket 38, to assure proper aligned engagement of the stem 14 with the housing 22.

The flange 24 of the housing 22 overlaps a portion of the shelf 18. Three screws extend through the openings 74 to secure the housing 22 in place. It is noted that the use of the screws may not be required, as the connection of the stem 14 to the housing 22 may be sufficient. The lens cover 80 (illustrated as attached in FIG. 10) is attached to the distal end of the housing 12. This is accomplished by pushing the ears 90 past the opposing flats 70. Rotation of the cap 80 brings the ears 90 between the flange 24 and the flange 64 to secure the cap to the housing 22.

The free ends of the electric wires 29 in the junction box 12 are connected to a source of electrical current. In the illustrated embodiment, a convenience outlet 176 and a switch 178 are used in the junction box 12. Electrical conduit is conventionally connected to the knockouts 172, 176 as appropriate for round or rectangular conduits. The switch 178 permits selectively actuating the lamp in the light fixture 16. The electrical connections of the wires from the conduit to the convenience outlet 176, to the switch 178, and to the wires 29 is conventional for one of ordinary skill in the art and no further discussion of the wiring connections is believed necessary.

The lighting fixture 10 of the present invention also surface mounts as illustrated in FIGS. 7 and 8 with the housing 22 received within the open end of the can 100. This is accomplished by locating a selected position for the lighting fixture 10 on the mounting surface 18. The hole 20 sized for receiving the stem 14 is created, such as by drilling or other cutting operation. It is noted that the stem 14 for surface mounting is longer than the stem 14 for recess mounting. The stem 14 is connected to the junction box 12 as discussed above by connecting the threaded end 152 to the junction box 12 with the nut 154. The junction box 12 is positioned on the mounting surface 18 with the stem 14 extending through the hole 20. The ribs 150 extending radially align the stem 14 within the hole 20 to minimize the contact of the stem with the sides of the hole in the mounting surface 18. The junction box 12 is secured to the mounting surface 18 as discussed above.

The electrical wires 29 are routed from the housing 22 through the open can 100 and into lower end 140 of the stem 14 and outwardly from the end 152. The can 100 attaches to the surface with screws extending through the openings 116 in the opposing shoes 114. The supports 113, 115 bear against the surface to provide lateral stability for the can 100. The subassembly of the housing 22 and the reflector 60 are then engaged to the surface can 100. This involves the socket 38 receiving the lower end 140 of the stem 14 as discussed above and the housing 22 interlocking with the can 100. The socket 38 receives the flange 142 in the stepped recess 126. The retaining clips 122 engage the recesses 144. The tabs 28 align with notches 106. As the housing 22 is pushed into the can 100, the tabs 28 flex and allow the housing 22 past the flange 104. The flanges 110 and 112 receive the tabs 28 therebetween to prevent rotation of the housing 12.

The free ends of the electrical wires 29 are connected to a source of line voltage for powering the light fixture 10, as well as the convenience outlet 176 and the switch 178, as discussed above. The lens cover 80 is attached as discussed above.

Using the knockouts 172, 174 in the walls of the junction box 12, two or more of the light fixtures 10 may be connected together in series, or parallel, for common or individual switched operation. It is to be appreciated that the convenience outlet 176 and switch 178 are features of alternate embodiments of the present invention of permanently mounted under-cabinet lighting fixtures. Further, the junction box 12 in an alternate embodiment encloses a transformer for using low-voltage light bulbs in the lighting fixture 10.

During operation, the lighting fixture 10 defines thermal pathways through the cap 80, the reflector 60, and the housing 22, for communicating heat from the lighting fixture to ambient air.

The present invention accordingly provides a permanently mounted under-cabinet lighting system suitable for either low-voltage or high-voltage (line) operations. The principles, preferred embodiments, and modes of operation of the present invention have been described in the foregoing specification. The invention is not to be construed as limited to the particular forms disclosed as these are regarded as illustrative rather than restrictive. Moreover, variations and changes may be made by those skilled in the are without departing from the spirit of the invention described in the following claims.

What is claimed is:

1. An under-cabinet lighting fixture, comprising:

a housing defining a socket having protruding latches, the housing adapted to receive a light bulb, to be mounted to a cabinet surface;

a junction box receiving electrical wires for connecting the light bulb in the housing to a supply of electrical current; and a stem defining recesses that engage the latches, the stem to be extended through an opening in the cabinet surface to connect the housing and the junction box, the stem defining a passageway of the electrical wires from the junction box to the light bulb in the housing.

2. The under-cabinet lighting fixture as recited in claim 1, wherein the socket defines a longitudinally extending slot; and wherein the stem defines an extended portion configured for being received in the slot, whereby the stem and socket are keyed for aligned engagement.

3. The under-cabinet lighting fixture as recited in claim 1, wherein the stem defines a second distal end that is threaded for engagement to the junction box.

4. The under-cabinet lighting fixture as recited in claim 1, wherein the junction box defines a knock-out plate adapted for removal for engaging a conduit to the junction box.

5. The under-cabinet lighting fixture as recited in claim 1, further comprising an electrical switch operatively connected the electrical wires within the junction box for selectively operating the light bulb within the housing.

6. The under-cabinet lighting fixture as recited in claim 1, further comprising an electrical outlet for connecting to a mating electrical plug for providing electrical current to another device.

7. The under-cabinet lighting fixture as recited in claim 1, wherein the housing defines an open end that opposes a base which defines a plurality of openings therein in a portion opposing the open end, and a plurality of projections extending from an edge of the housing at the open end;

a reflector defining a dished cavity and seating on the projections to define a gap between the reflector and the housing;

a lamp socket received in the housing with a lamp engaged to the lamp socket, the lamp in alignment with the thickened portion of the base; and a cap received on the housing, the cap having a plurality of spaced-apart ports, whereby the lighting fixture defines a pathway for communicating air through the ports, the gap, and the openings, for air to flow past the reflector for communicating heat from the reflector to ambient air.

8. The under-cabinet light fixture as recited in claim 7, wherein the base defines a plurality of stand-off posts extending from the base opposing the open end.

9. The under-cabinet lighting system as recited in claim 7, wherein the base defines a thickened portion in alignment with the light bulb for restricting flow of heat from the bulb through the base.

10. The under-cabinet light fixture as recited in claim 7, further comprising an insulating pad received within the housing in alignment with the thickened portion.

11. The under-cabinet light fixture as recited in claim 7, wherein the openings are defined in the base.

12. The under-cabinet light fixture as recited in claim 11, further comprising an open-ended can for receiving through one end the housing and defining a pair of opposing shoes having an opening for receiving a fastener to connect the can to a mounting surface.

13. The under-cabinet light fixture as recited in claim 7, further comprising a notch in a side of the housing for matingly receiving the socket.

14. The under-cabinet light fixture as recited in claim 13, wherein the reflector defines a slot for receiving the socket by seating the reflector on the open end of the housing, the socket extending through the slot inwardly of the cavity defined by the reflector for receiving the lamp bulb therein.

15. The under-cabinet light fixture as recited in claim 7, further comprising an open-ended can for receiving the housing through one end and defining a pair of opposing shoes for receiving a fastener to secure the can to a mounting surface.

16. The under-cabinet light fixture as recited in claim 7, wherein the reflector defines a plurality of openings therein for communicating air from the openings in the cap to the openings in the housing, for carrying heat from the reflector out of the fixture.

17. The under-cabinet light fixture as recited in claim 7, wherein the cap defines a central opening configured to receive a translucent sheet.

18. The under-cabinet lighting fixture as recited in claim 1, wherein the housing comprises:

a puck-shaped body defining an open end that opposes a base having at least a thickened portion;

the base defining a plurality of openings;

a plurality of projections extending from an edge of the body at the open end;

a reflector defining a dished cavity and seating on the projections to define a gap between the reflector and the body;

a lamp socket and lamp received in the body with the lamp in substantial alignment with the thickened portion of the base;

a pad of insulative material received within the body in substantial alignment with the thickened portion of the base; and a cap received on the body and defining a plurality of spaced-apart ports, the cap receiving a translucent sheet to provide a cover over the lamp for communicating light therefrom; and electrical wires connected to the socket for communicating currant to the lamp for lighting the light fixture, whereby the lighting fixture defines a pathway for communicating the air through the ports, the gap, and the openings, for air to flow past and about the reflector for communicating heat from the reflector to ambient air.

19. A cabinet and lighting fixture of a permanently-mounted type, comprising:

a cabinet defined by interconnected walls with one of the walls defining a hole;

a housing with a lighting fixture adapted to receive a light bulb and mounted to a first surface of said one of the walls;

a junction box receiving electrical wires connecting the lighting fixture in the housing to a supply of electrical current and mounted to an opposing second surface of said one of the walls; and a stem extended through the bole in said one of the walls and connected at a first end to the housing and at the opposing end to the junction box, the stem defining a passageway of the electrical wires from the junction box to the lighting fixture in the housing.

20. The cabinet and lighting fixture as recited in claim 19, wherein the housing defines a socket having first connecting members and wherein the stem has second connecting members that matingly engage the fist connecting members, whereby the stem connects to the housing by disposing the stem in the socket.

21. The cabinet and lighting fixture as recited in claim 20, wherein the first connecting members are protruding latches and the second connecting members comprise a distal end of the stem defining recesses that engage the latches upon insertion of the stem into the socket.

22. The cabinet and lighting fixture as recited in claim 20, wherein the stem comprises a threaded distal end for connecting with a nut to the junction box.

23. The cabinet and cabinet lighting fixture as recited in claim 19, wherein the housing comprises:

a puck-shaped body defining an open end that opposes a base having at least a thickened portion;

the base defining a plurality of openings;

a plurality of projections extending from the open end;

a reflector defining a dished cavity and seating on the projections to define a gap between the reflector and the body;

a lamp socket and lamp received in the body with the lamp in substantial alignment with the thickened portion of the base;

a pad of insulative material received within the body in substantial alignment with the thickened portion of the base; and a cap received on the body and defining a plurality of space-apart ports, the cap receiving a translucent sheet to provide a cover over the lamp for communicating light therefrom; and electrical wires connected to the socket for communicating currant to the lamp for lighting the light fixture, whereby the lighting fixture defines a pathway for communicating the air through the ports, the gap, and the openings, for air to flow past and about the reflector for communicating heat from the reflector to ambient air.

* * * * *